US005305713A

United States Patent [19]

Vadakin

[11] Patent Number: 5,305,713

[45] Date of Patent: Apr. 26, 1994

[54] ANGULAR ROTATION ROTARY CLEANING DEVICE

[75] Inventor: Thomas C. Vadakin, Marietta, Ohio

[73] Assignee: Vadakin, Inc., Marietta, Ohio

[21] Appl. No.: 921,259

[22] Filed: Jul. 29, 1992

[51] Int. Cl.[5] ..... F22B 37/52

[52] U.S. Cl. ..... 122/391; 122/392; 122/379; 134/172

[58] Field of Search ..... 122/379, 381, 382, 392, 122/391, 390; 134/172; 15/317, 318

[56] References Cited

U.S. PATENT DOCUMENTS 4,715,324 12/1987 Muller ..... 122/381
4,844,021 7/1989 Stoss ..... 122/392
4,907,542 3/1990 Maeyama et al. ..... 122/391
4,945,862 8/1990 Vadakin ..... 122/392
4,971,140 11/1990 Stoss ..... 122/392
5,113,802 5/1992 Le Blanc ..... 122/392

*Primary Examiner*—Henry C. Yuen
*Attorney, Agent, or Firm*—Laubscher & Laubscher

[57] ABSTRACT

An improved rotary cleaning device for removing slag deposits from the surfaces of pendant tubes in a steam generator boiler is characterized by a controlled rotary actuator mechanism which alternately rotates a cleaning lance in opposite directions through an angle less than 90°. By limiting rotation of the lance, the cleaning fluid from the lance is directed only upon a limited tube surface area, thereby reducing the time required to clean the tube surfaces.

9 Claims, 4 Drawing Sheets

ANGULAR ROTATION ROTARY CLEANING DEVICE

BACKGROUND OF THE INVENTION

Solid fossil fueled steam generation creates a self-imposed spent fuel ash deposit on the fire side of the pendant tube elements making up the interior configuration of the boiler. This ash build up eventually becomes inhibitive to the heat transfer and draft characteristics necessary to efficiently produce steam generation. Removal of the spent ash deposit from external tube surfaces, in many situations, is very difficult. The degree of difficulty for removing spent fuel deposits depends on the amount, hardness, and location of the deposit, as well as on the bond of the deposit to the pendant tube surface. The more difficult the deposit is to remove, the more down time is required to clean the boilers. The present invention relates to an improved rotary cleaning device for quickly and efficiently removing ash or slag deposits from boiler tubes.

BRIEF DESCRIPTION OF THE PRIOR ART

Various devices for removing deposits from boiler tube surfaces are well-known in the patented prior art as evidenced by the Mueller U.S. Pat. No. 4,715,324 which discloses a high pressure water lance which is oscillated and moved incrementally inward along the central tube lance of a nuclear steam generator to dislodge sludge from the tube plate and heat exchange tubes.

Also known in the art are rotary cleaning devices such as that disclosed in the Vadakin U.S. Pat. No. 4,945,862 which comprises a shuttle cleaning device with a cleaning lance which rotates through 360°. The lance includes a plurality of radially spaced orifices which direct a cleaning fluid under high pressure against the tube surfaces to remove slag deposits therefrom.

While the prior devices normally operate satisfactorily, the cleaning time is relatively long since, during rotation of the lance through 360°, there are periods when the jets of cleaning fluid are directed parallel to the tube surfaces rather than impinging directly thereon. The present invention was developed in order to increase the impingement concentration of the cleaning fluid by increasing the periods of dwell time on the deposit surfaces while eliminating wasteful spray in directions other than against the tube surfaces.

SUMMARY OF THE INVENTION

Accordingly, it is a primary object of the present invention to provide an improved apparatus for cleaning spaced parallel rows of pendant tubes in boilers including a frame arranged parallel to the tubes and a cleaning assembly connected with the frame for cleaning the exterior surfaces of the tubes. The cleaning assembly includes a tubular lance containing a plurality of spaced radial openings. The lance extends between the tubes with its axis arranged perpendicular thereto. A pressurized cleaning fluid is delivered to the lance which is reciprocally rotated through an angle less than 180° to direct the pressurized cleaning fluid onto a limited area of the adjacent pendant tube surfaces to remove slag deposits therefrom.

According to a further object of the invention, a rotary actuator mechanism connects the lance with the frame and a control device is connected with the rotary actuator mechanism to control the speed and angle of rotation of the lance. The rotary actuator mechanism is preferably an air-driven gear mechanism having two inputs for rotating the lance in opposite directions, respectively. The control device includes a pilot valve and two inhibitors connected with a pressurized air supply. Each inhibitor is connected with one of the inputs of the gear mechanism. The pilot valve controls the operation of the inhibitors to alternately deliver air pressure to the inputs of the gear mechanism to control reciprocal rotation thereof.

It is another object of the invention to provide a hoist mechanism for displacing the frame parallel to the pendant tubes in order to transport the lance along the length of the tubes. The frame further includes a bracket on which the cleaning assembly is mounted. The bracket is angularly adjustable and slidably connected with the frame for pivoting and laterally displacing the lance with respect to the tubes.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
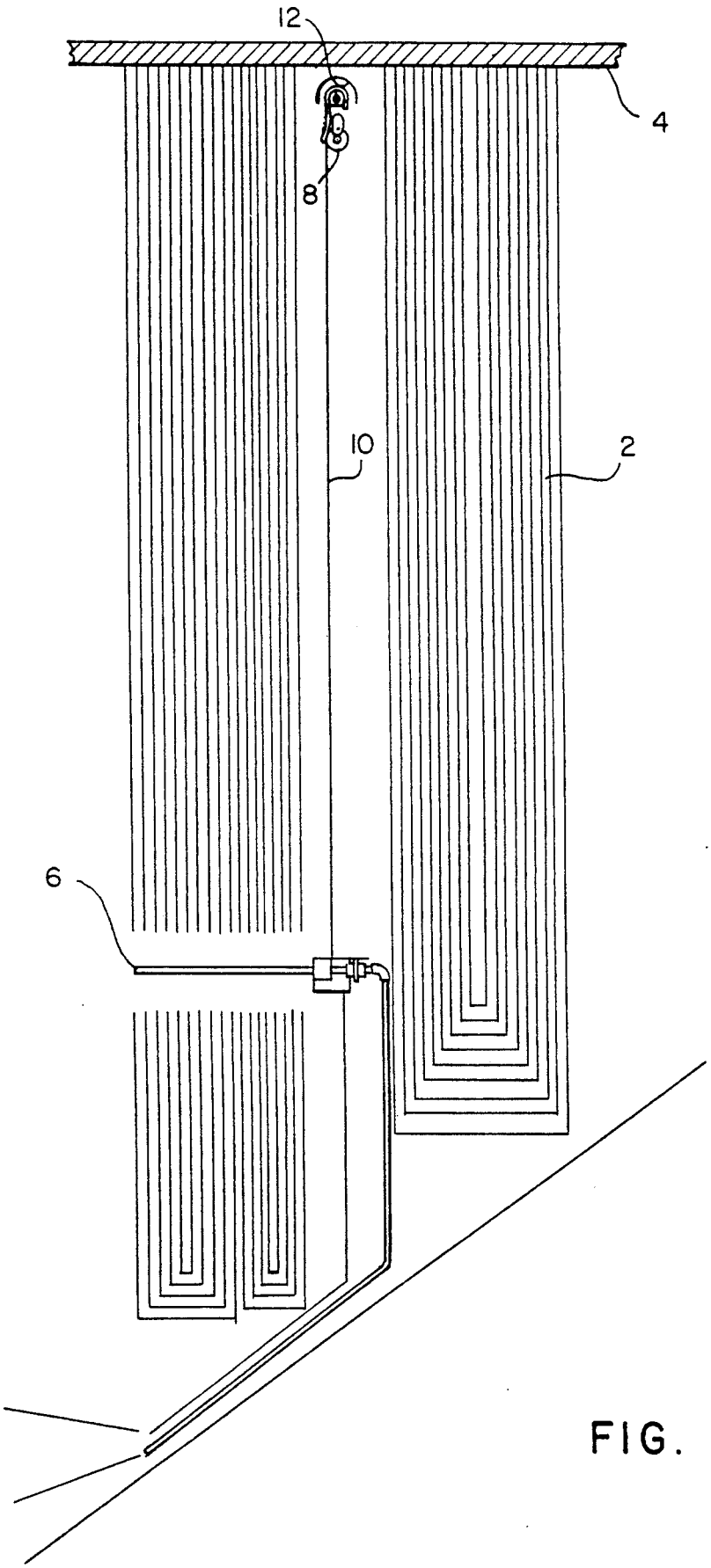
FIG. 1 is a partial plan view illustrating the arrangement of the cleaning device of the present invention within a section of pendant tubes of a boiler.

Referring first to FIG. 1, there is shown a steam generator boiler within which are arranged a plurality of spaced parallel vertical pendant tubes 2 depending from the roof 4 of the boiler. The cleaning device 6 according to the invention is suspended within the boiler between the rows of pendant tubes 2. More particularly, a pulley 8 is connected with a wall of the boiler adjacent the roof thereof, and a cable 10 passes through an opening 12 in the boiler sidewall and over the pulley B. Connected with the end of the cable 10 is the cleaning device 6 of the invention.

Figure 2:
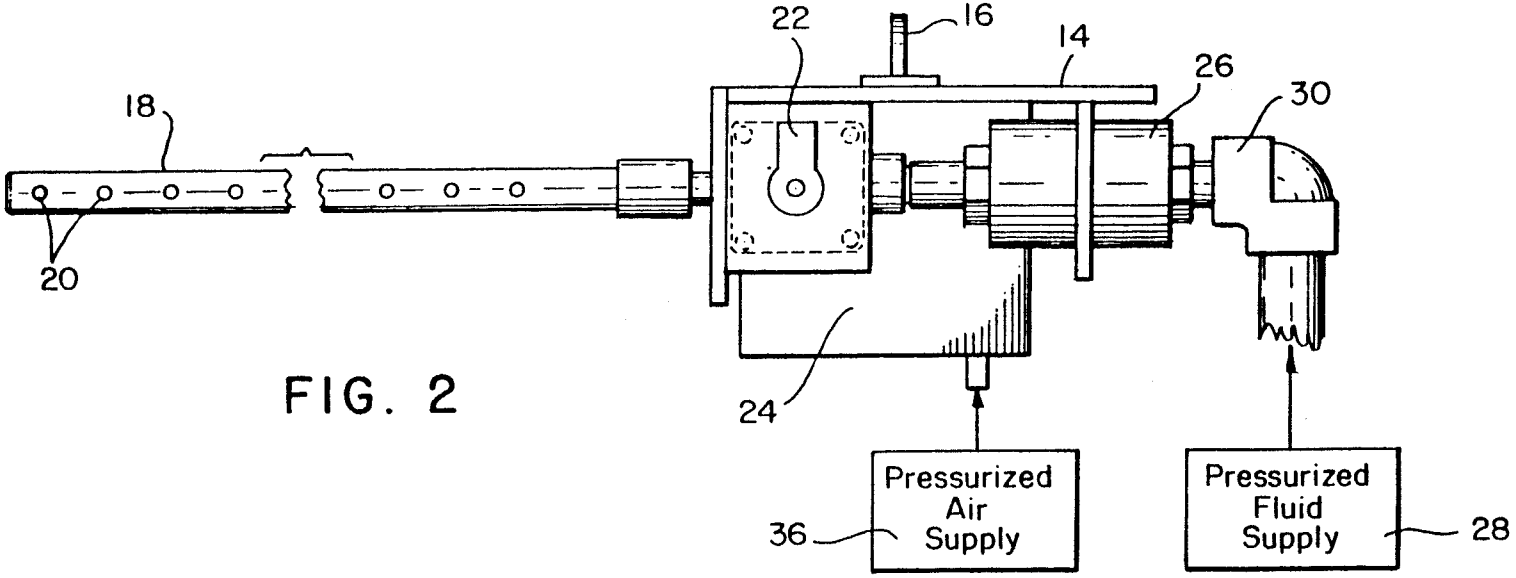
FIG. 2 is a front plan view of the cleaning device of the invention.
Figure 3:
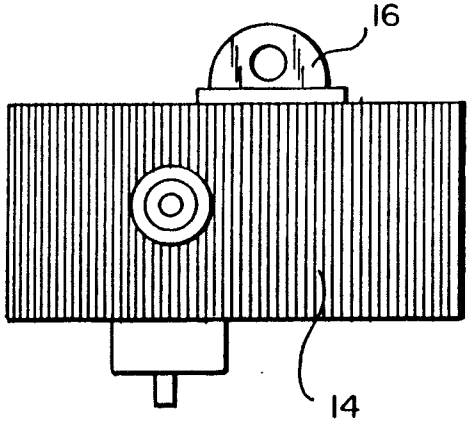
FIG. 3 is a side plan view of the device of FIG. 2.

The rotary cleaning device will be described with reference to FIG. 2 and 3. The device includes a frame 14 having a hanging bracket 16 connected with the upper end thereof which receives the end of the cable 10 for suspension between the rows of pendant tubes. Connected with frame is a tubular lance 18 containing a plurality of radially spaced orifices 20 along the length thereof. As shown in FIG. 1, the axis of the lance 18 is arranged perpendicular to the orientation of the pendant tubes to be cleaned, with the lance extending between a plurality of tubes. Adjacent the frame, the lance is connected with a rotary actuator mechanism 22 which in turn is connected with the frame 14. As will be developed in greater detail below, a control mechanism 24 is provided to control the operation of the rotary actuator mechanism 22. Extending from the rear of the rotary actuator mechanism 22 is a rotary union 26 with which is connected a pressurized fluid supply 28 via a coupling 30. The rotary union enables the pressurized fluid to be supplied to the interior of the lance 18, and affords rotation of the lance 18 by the rotary actuator mechanism 22. More particularly, the rotary actuator mechanism reciprocally rotates the lance in opposite directions about its axis through an angle less than 180° (and preferably less than 90°). When pressurized fluid is supplied to the interior of the lance, it exits the lance via the orifices 22 and impinges upon a limited area of the adjacent pending tube surfaces in accordance with the angle of reciprocal rotation of the lance. The impinging cleaning fluid on the surfaces of the pendant tubes serves to remove slag deposits therefrom. Preferably, the cleaning fluid comprises water.

Figure 4:
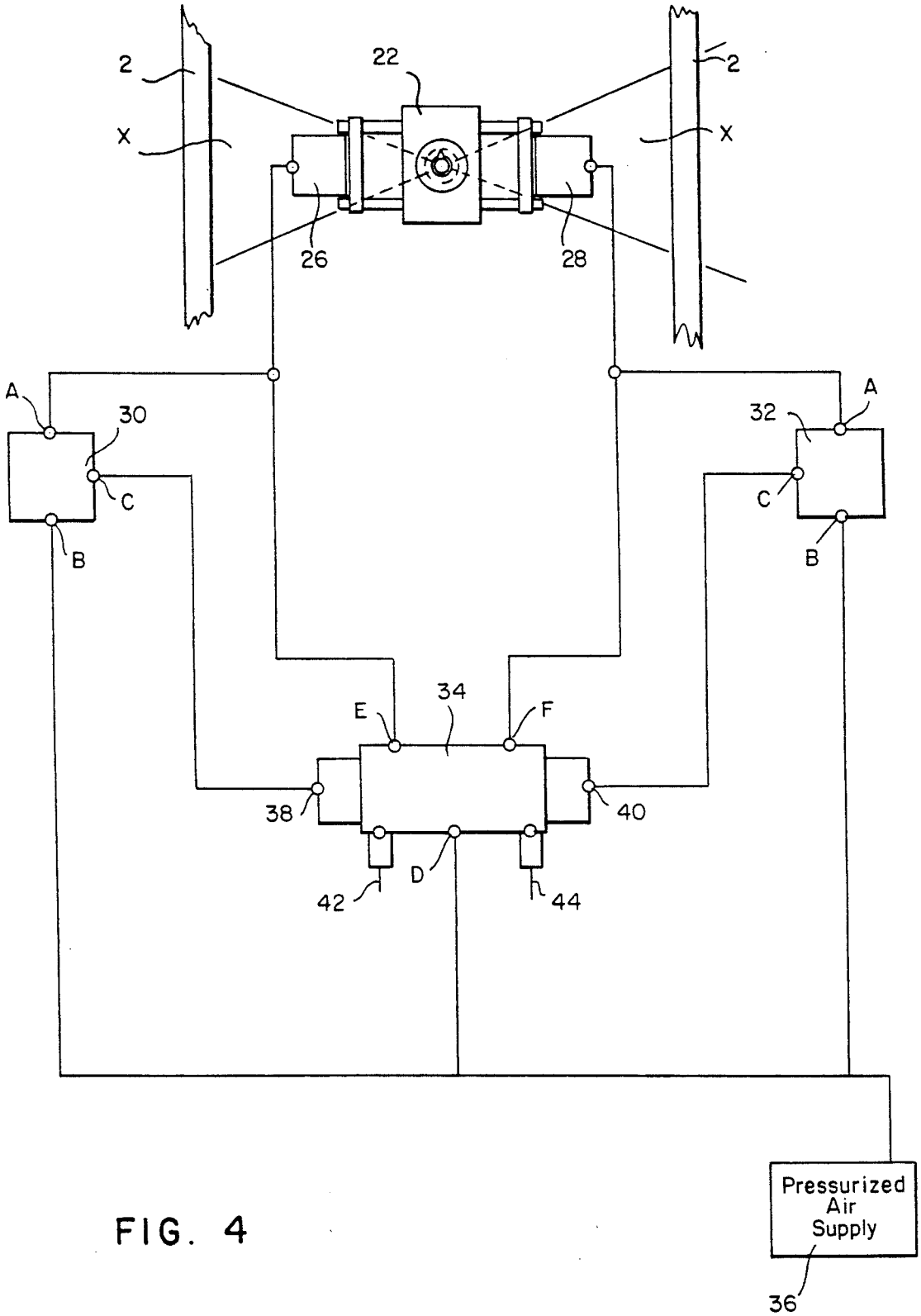
FIG. 4 is a schematic diagram of the control apparatus for reciprocally rotating the lance of the cleaning device of FIG. 2.

Referring now to FIG. 4, the operation of the rotary actuator mechanism will now be described. The rotary actuator mechanism 22 preferably comprises an air-driven gear mechanism and includes left 26 and right 28 cylinders comprising first and second inputs. Connected with the left and right cylinders of the rotary actuator mechanism are left 30 and right 32 inhibitors and a pilot valve 34. A pressurized air supply 36 is connected with the left and right inhibitors 30, 32 as well as the pilot valve 34. Each inhibitor includes a port A connected with the cylinders of the gear mechanism, a port B connected with the pressurized air supply 36, and a port C connected with the pilot valve 34. The pilot valve includes left 38 and right 40 pilots connected with the left and right inhibitors 30, 32, respectively. The pilot valve also includes a port D connected with the pressurized air supply 36, a port E connected with the left cylinder 26, and a port F connected with the right cylinder 28. Finally, the pilot valve 34 includes left and right exhaust speed controls 42, 44 for purposes to be described below.

The circuit shown in FIG. 4 is charged with air pressure from the pressurized air supply 36. The left and right inhibitors 30, 32 detect the stroke of the air-driven gear mechanism 22 by sensing the absence of air pressure in the end of the left or right cylinders 26, 28 being exhausted through the left or right exhaust ports of the pilot valve 34. The exchange of pressure sensed by the inhibitor signals the pilot valve to activate, thereby exhausting the pressure on the opposite side and activating air pressure to the same side input cylinder to drive the rotary actuator mechanism through its reciprocating cycle. The speed of rotation of the lance is controlled by the exhaust speed controls 42, 44 of the pilot valve. The angle of rotation of the lance is controlled via the pilot valves 38, 40 on opposite sides of the pilot valve 34.

By controlling the angle of rotation of the lance, the "field" of impingement of the cleaning fluid exiting the lance orifices can be limited, whereby the maximum cleaning force is directed across a given area of the pendant tube surfaces. For example, in the embodiment shown in FIG. 4, the actuator gear mechanism rotates through an angle of approximately 451 to define fields X on opposite sides of the lance within which the cleaning spray is confined. After the pendant tube sections within the field X have been cleaned, the entire cleaning assembly can be displaced by pulling or releasing the cable 10 to move the cleaning assembly 6 vertically along the pendant tubes for cleaning an adjacent section. The operation is repeated for incremental sections of the pendant tubes until the entire length of the tubes has been cleaned and all of the slag deposits removed therefrom.

Figure 5:
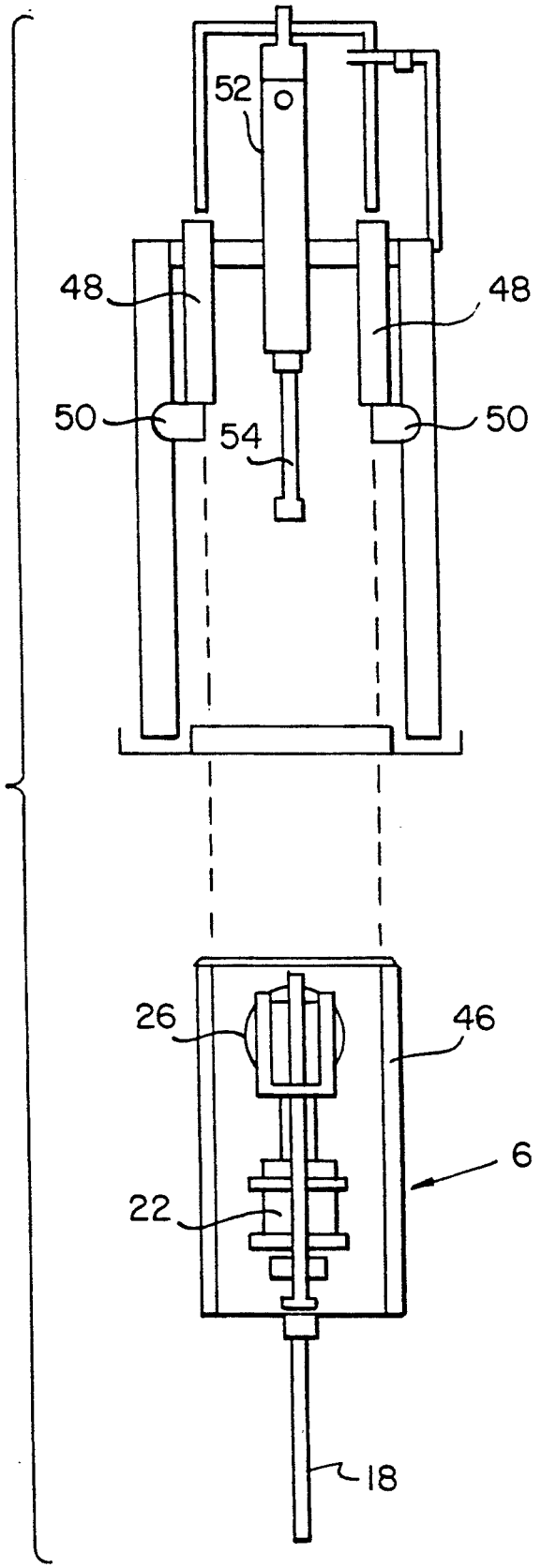
FIG. 5 is an exploded view of an alternate embodiment of the invention including a bracket slidably and pivotally connected with the frame.

An alternate construction of the frame of the cleaning assembly is shown in FIG. 5. In this embodiment, the rotary union 26, the rotary actuator mechanism 22, and the lance are connected with slide brackets 46 which engage fixtures 48 connected with a pivot mechanism 50, whereby the cleaning assembly may be slidably connected with the pivoting bracket. Also connected with the pivotal bracket is a cylinder 52 and piston 54 assembly. The cylinder 52 is preferably an air cylinder connected with the air pressure source 36 to control the displacement of the piston. The piston is connected with the slide brackets 46 of the cleaning assembly to reciprocate the cleaning assembly relative to the frame under control of the air pressure source. The slide bracket 46 can be angularly adjusted relative to the frame at any angle between 0 to 90½, whereby the lance can be angularly adjusted for cleaning pendant tube arrays having different configurations. Moreover, the slide bracket 46 can be laterally displaced with respect to the frame so that the lance can in turn be laterally transported in a direction along its axis perpendicular to the pendant tubes.

It will be appreciated by those skilled in the art that while a pneumatically operated gear mechanism has been disclosed, a hydraulic or electric control mechanism for reciprocally rotating the lance may also be provided. Furthermore, specifically configured jet orifices may be installed in the various openings 20 in the lance 18 to define a cleaning spray having a focussed high pressure impingement stream of fluid defined thereby.

While in accordance with the provisions of the patent statute and the preferred forms and embodiments have been illustrated and described, it will be apparent to those of ordinary skill in the art that various changes and modifications may be made without deviating from the inventive concepts set forth above.

I claim:

1. Apparatus for cleaning spaced parallel rows of pendant tubes in boilers, comprising (a) a frame arranged parallel to the pendant tubes;

(b) cleaning means connected with said frame for cleaning the exterior surfaces of the pendant tubes, said cleaning means including;

(1) a tubular lance extending between the tubes and having an axis arranged perpendicular to the parallel tubes, said lance containing a plurality of spaced radial openings;

(2) means for delivering a pressurized cleaning fluid to said lance; and (3) means for adjustable reciprocally rotating said lance through a selected angle less than 180°, whereby the cleaning fluid exits said lance via said openings and impinges on a limited area of the adjacent pendant tube surfaces in accordance with the selected angle of rotation of said lance to remove slag deposits from the tube surfaces.

2. Apparatus as defined in claim 1, and further comprising a rotary union connected between said fluid delivering means and said lance.

3. Apparatus as defined in claim 2, wherein said rotating means includes (1) a rotary actuator mechanism; and (2) control means connected with said rotary actuator mechanism for controlling the speed and angle of rotation of said lance.

4. Apparatus as defined in claim 3, wherein said rotary actuator mechanism is an air-driven gear mechanism including first and second inputs for rotating said lance in opposite directions.

5. Apparatus as defined in claim 3, and further comprising means for displacing said frame parallel to the pendant tubes, whereby said lance can be transported along the length of the tubes.

6. Apparatus as defined in claim 3, and further comprising a bracket angularly adjustably connected with said frames, said cleaning means being connected with said bracket.

7. Apparatus as defined in claim 6, wherein said bracket is slidably connected with said frames, whereby said lance may be displaced laterally with respect to the tubes.

8. Apparatus for cleaning spaced parallel rows of pendant tubes in boilers, comprising (a) a frame arranged parallel to the pendant tubes;

(b) cleaning means connected with said frame for cleaning the exterior surfaces of the pendant tubes, said cleaning means including;

(1) a tubular lance extending between the tubes and having an axis arranged perpendicular to the parallel tubes, said lance containing a plurality of spaced radial openings;

(2) means for delivering a pressurized cleaning fluid to said lance;

(3) a rotary union connected between said fluid delivery means and said lance;

(4) an air-driven gear rotary actuator mechanism including first and second inputs for reciprocally rotating said lance in opposite directions through an angle less than 180°; and (5) control means connected with said rotary actuator mechanism for controlling the speed and angle of rotation of said lance, said control means including (i) first and second inhibitors connected with said first and second inputs, respectively, and with a pressurized air supply; and (ii) a pilot valve connected with said first and second inhibitors and between said air supply and said first and second inputs, said pilot valve controlling the operation of said inhibitors to alternately deliver air pressure to said first and second inputs, whereby the cleaning fluid exits said lance via said openings and inpinges on a limited area of the adjacent pendant tube surfaces in accordance with the angle of rotation of said lance to remove slag deposits from the tube surfaces.

9. Apparatus as defined in claim 8, wherein said pilot valve includes first adjustment means for controlling the speed of rotation of said lance and second adjustment means for controlling the angle of rotation of said lance.

* * * * *